US006079162A

United States Patent [19]

Hein

[11] Patent Number: 6,079,162

[45] Date of Patent: Jun. 27, 2000

[54] PARTITION FORMING A DRAFT-FREE FIRE BARRIER; AND A DRAFT-FREE FIRE BARRIER; AND, FURTHER, METHODS OF THEIR OPERATION

[75] Inventor: Christian Hein, Langenhagen, Germany

[73] Assignee: DORMA GmbH + Co. KG, Ennepetal, Germany

[21] Appl. No.: 09/135,137

[22] Filed: Aug. 17, 1998

Related U.S. Application Data

[63] Continuation-in-part of application No. PCT/DE97/01759, Aug. 16, 1997.

[30] Foreign Application Priority Data

Dec. 16, 1996 [DE] Germany ..... 196 51 947

[51] Int. Cl.[7] ..... E04H 9/00

[52] U.S. Cl. ..... 52/1; 49/1; 49/6

[58] Field of Search ..... 52/1; 49/1, 6

[56] References Cited

U.S. PATENT DOCUMENTS 1,052,610 2/1913 Moody ..... 49/1

FOREIGN PATENT DOCUMENTS

| | | |
|---|---|---|
| 6567680 | 6/1981 | Australia . |
| 2114072 | 6/1972 | France . |
| 2158734 | 6/1973 | France . |
| 1584060 | 3/1970 | Germany . |
| 2531314 | 2/1976 | Germany . |
| 3928911 | 3/1990 | Germany . |
| 4014727 | 12/1990 | Germany . |
| 19522366 | 11/1996 | Germany . |
| 674544 | 6/1990 | Switzerland . |

*Primary Examiner*—Christopher T. Kent

*Attorney, Agent, or Firm*—Nils H. Ljungman & Associates

[57] ABSTRACT

This invention relates to a fire barrier which includes a functional combination of at least one single-panel casement panel and a sliding panel which is connected or adjacent to it. The sliding panel, which can be automatically moved horizontally during normal operation, contains an auxiliary drive mechanism which, in an emergency, moves the sliding panel without an outside power source into the open position. The casement panel is moved simultaneously by a closing mechanism from its fixed or open position into the correct closed position to create or act as a barrier.

15 Claims, 9 Drawing Sheets

PARTITION FORMING A DRAFT-FREE FIRE BARRIER; AND A DRAFT-FREE FIRE BARRIER; AND, FURTHER, METHODS OF THEIR OPERATION

CONTINUING APPLICATION DATA

This application is a Continuation-In-Part application of International Application No. PCT/DE97/01759, filed on Aug. 16, 1997, which claims priority from Federal Republic of Germany Patent Application No. 196 51 947.0, filed on Dec. 16, 1996. International Application No. PCT/DE97/01759 was pending as of the filing date of the above-cited application. The U.S. was an elected state in International Application No. PCT/DE97/01759.

BACKGROUND OF THE INVENTION

1. Field of the Invention

This present invention relates generally to a draft-free fire barrier and a partition that is openable and closable in the event of a fire to permit persons to exit an area containing a fire while still forming a draft-free fire barrier, in which the rotationally mounted panels or leaves or wings are attached to a frame or casing by means of fasteners or hinges. A closing mechanism which works without outside energy is attached to the frame around the panels and interacts with the panels, causing the panels to move from an open position into a closed position, thus creating a fire barrier or acting as a fire barrier. The closing mechanism is actuated when a warning signal indicating the possibility of fire in the area reaches the mechanism from a smoke detector. The present invention further relates to a method for the operation of the partition.

2. Background Information

Such partitions are installed in particular in public buildings, hospitals, hotels, factories, etc., so that when a fire breaks out, persons inside the building have a means of escape that also serves as a barrier to prevent the fire from spreading to other parts of the building. Buildings are divided into individual fire compartments which are separated by fire walls. These fire walls effectively seal one building compartment from another, so that any fire that breaks out in one area will not spread to another. Movable partitions are therefore a necessity because it would be impossible to seal a compartment against fire yet allow the free movement of occupants in and out of the room. Such partitions must then simultaneously meet two requirements; i.e. they must close automatically when a fire breaks out to complete a fire wall, and simultaneously allow any persons who may still be in the room at the time to leave the room unharmed. Therefore such partitions are located in the escape routes to create a safe fire-proof passage for building occupants while preventing the spread of fire from the room.

Repeated attempts have been made to equip automatic sliding doors so that they can also be used as fire barriers or to create a fire barrier, yet still be permissible for use in escape routes. Building authorities and building regulations set very strict guidelines for the construction and operation of sliding doors, and current sliding doors do not fit the requirements to be used in fire escape routes. In the event of a fire, the barrier or partition, by rule, must automatically close to seal off an area and prevent the fire from spreading. Sliding doors can accomplish this task quite easily, but fail to accomplish the other requirement of being able to be opened by persons inside the area. Building occupants would therefore be trapped inside because sliding doors have neither handles with which a person could grasp to force open the partition, nor a functioning automatic opening mechanism since the power to the opening mechanism would have been turned off. If a person were to be able to pry the sliding doors open, this would create a situation where the doors would remain open and the fire-wall would be compromised. Therefore, sliding doors, as they are currently constructed and without any additional measures or features, cannot be used as fire barriers and certainly cannot be used in escape routes or as escape passages.

By way of example, a fire door which is equipped with a fire-protection door leaf is described in German Patent No. 195 22 366 A1. The fire door described in this prior art document is made of wood, although door panels made of steel and filled with a suitable material such as light alloy or glass are also used in the form of framed doors and are generally realized with a glass filling when they are used as fire doors.

Because such doors which are realized in the form of casement doors, i.e. the door leaf is fastened to a casing so that the door panel can swing, are normally left open to permit the flow of people and goods to pass unimpeded, such doors are equipped with a smoke detector which triggers an alarm and, among other things, with electric door retaining and closing devices, as disclosed in German Patent No. 25 31 314 A1. This type of door is equipped with a closing mechanism which works without outside energy. The door closers in question can be both top-mounted door closers and floor-mounted door closers. If the door in question is a two-panel door, there is also a closing sequence control device which guarantees that with door panels which generally overlap, first the fixed panel, i.e. the panel which is normally closed, and only then the moving panels are moved into the proper closed position. The electrical retaining devices make it possible to keep the door panels in the open position, and only when a fire alarm is emitted by means of the smoke detector are these door panels then moved into the proper closed position.

As an alternative to the device described in the above referenced German Patent No. 25 31 314 A1, magnetic clamps can also be used, e.g. such as those which are described in the DORMA EM advertising brochure, as a precautionary fire protection measure. These magnetic door clamps simultaneously represent holding or retaining devices which hold the fire doors in the open position. When there is a risk of fire, the holding device is deactivated by a tripping device (smoke detector and control unit).

The known art also discloses devices for the automatic closing of fire doors, on which sliding doors can be closed in response to the melting of an element as a result of elevated temperatures, because there are counterweights which move such a door into the closed position.

An automatic sliding door with at least one door panel is described in German Patent No. 40 14 727 A1, whereby the sliding door is equipped with an additional auxiliary drive mechanism in addition to the standard drive mechanism. For the normal closing of the door panels, energy is fed to and stored in the auxiliary drive mechanism. In the event of a power failure or interruption of the line power, and/or in the event of a simultaneous interruption of the normal operation of the sliding door, this stored energy automatically opens the sliding door. The auxiliary drive mechanism thereby preferably consists of a rubber or elastic element which is stretched by the closing of the sliding panels and moves the panel(s) out of the closed position in the event of a power failure and a simultaneous and related separation of a coupling between the drive motor and the actuator device. In addition to the above-mentioned rubber element, other auxiliary drive mechanisms can also be used, e.g. in the form of compression or tension springs.

OBJECT OF THE INVENTION

An object of the invention is to create a partition which can also be operated automatically, i.e. in normal operation the partition is opened and closed automatically, and can be reliably closed even in the event of a fire, while still allowing people inside the building to pass through.

Another object of the invention is to create a fire door which can also be operated automatically, i.e. in normal operation the door is opened and closed automatically, and can be reliably closed even in the event of a fire, while still allowing people inside the building to pass through.

SUMMARY OF THE INVENTION

The invention teaches that the objects can be accomplished by the use as a fire door of a combination which consists of a one-panel or two-panel casement or swinging or side-hung door which is certified for use as a fire door, and is simultaneously combined with an additional door which automatically moves horizontally, on which there is also an auxiliary drive mechanism which, in an emergency, moves the horizontally movable panel into the open position without outside energy. The horizontally movable door can be a sliding door or also a telescoping door, for example.

The conventional fire doors, on which the panels are realized in the form of casement panels and are provided with a door retaining device, which can be connected to a closing mechanism, are triggered in response to a signal from a smoke detector by the retaining device when they are in the open and fixed or locked position, and are moved into the closing position by the closing mechanisms. The closing mechanism can, for example, be in the form of a door closer which can be realized in the form of a floor-mounted or a top-mounted door closer, or also in the form of an internal door closer which is installed inside the door panels. As has been demonstrated in practice, such fire doors are generally left in the open position so that they do not interfere with traffic. But to guarantee a draft-free environment for the persons in the area, it is desirable to close and open the passage automatically, without disregarding the fire protection requirements. Many architects have therefore long wished for such doors to be automated. For this reason, the present invention teaches the introduction of an additional door. To avoid any interference with the escape route, only horizontally movable doors are appropriate, because in an emergency, such a door must not block the escape route of the people leaving the building. For this reason, the automatically operating horizontally movable door, which is described below in the form of a sliding door, and which can be equipped with one or two panels, has an auxiliary drive mechanism, to which the necessary energy is supplied during the closing of the door panel.

Although in this case two different types of doors, namely a casement door and a sliding door, are combined with one another to form a unit, such a system in its entirety must be considered a fire door. The casement panels of the outer door are realized in the form of a fire door, and the sliding door which is located inside the building is used for normal operation.

The invention teaches that the sequence of operation of such a fire door is as follows:

The smoke detector or sensor generates an alarm signal which is used to trigger the door retaining device, e.g. a magnetic clamp, or a device which is located inside a closing sequence control device. That means that the one-panel or multi-panel casement doors which were previously in the open position are moved into the normal closed position by the closing mechanisms to which they are connected. At the same time, however, the signal from the smoke detector de-energizes the drive mechanism of the sliding door which is normally operated automatically. The result is a separation by means of a coupling, such as an electric clutch, between the normal drive mechanism and the drive belt of the panels of the sliding door. Because during the closing of the sliding panel, energy is supplied to the auxiliary drive, which can be in the form of a rubber or elastomeric cable or a spring, for example, this auxiliary drive becomes active after the coupling has made the separation, and moves the sliding panel into the open position. It is thereby guaranteed that the escape route will remain open, whereby at the same time a fire compartment is closed so that as they move along the escape route, any persons who may still be inside the building can pass unhindered through the passage now left open by the horizontally movable door, and, by applying a force to the casement panels, they can open these panels in the direction of the escape route. After the people have passed through the casement door, this door closes automatically as a result of the closing mechanism to which it is connected.

A fire door equipped in the manner described above is characterized on one hand by its compact size, and also by the fact that it can be retrofitted in existing buildings. This retrofitting can be done by suspending the door frame of the automatic horizontal door drive mechanism on the door structure above the casement doors, so that it then represents a unit with the specified type of control system for both doors. It is also possible to equip such doors with corresponding stationary side parts and transom lights or overhead lights.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiments which are illustrated schematically in the accompanying drawings, wherein.

DESCRIPTION OF THE PREFERRED EMBODIMENT

Figure 4:
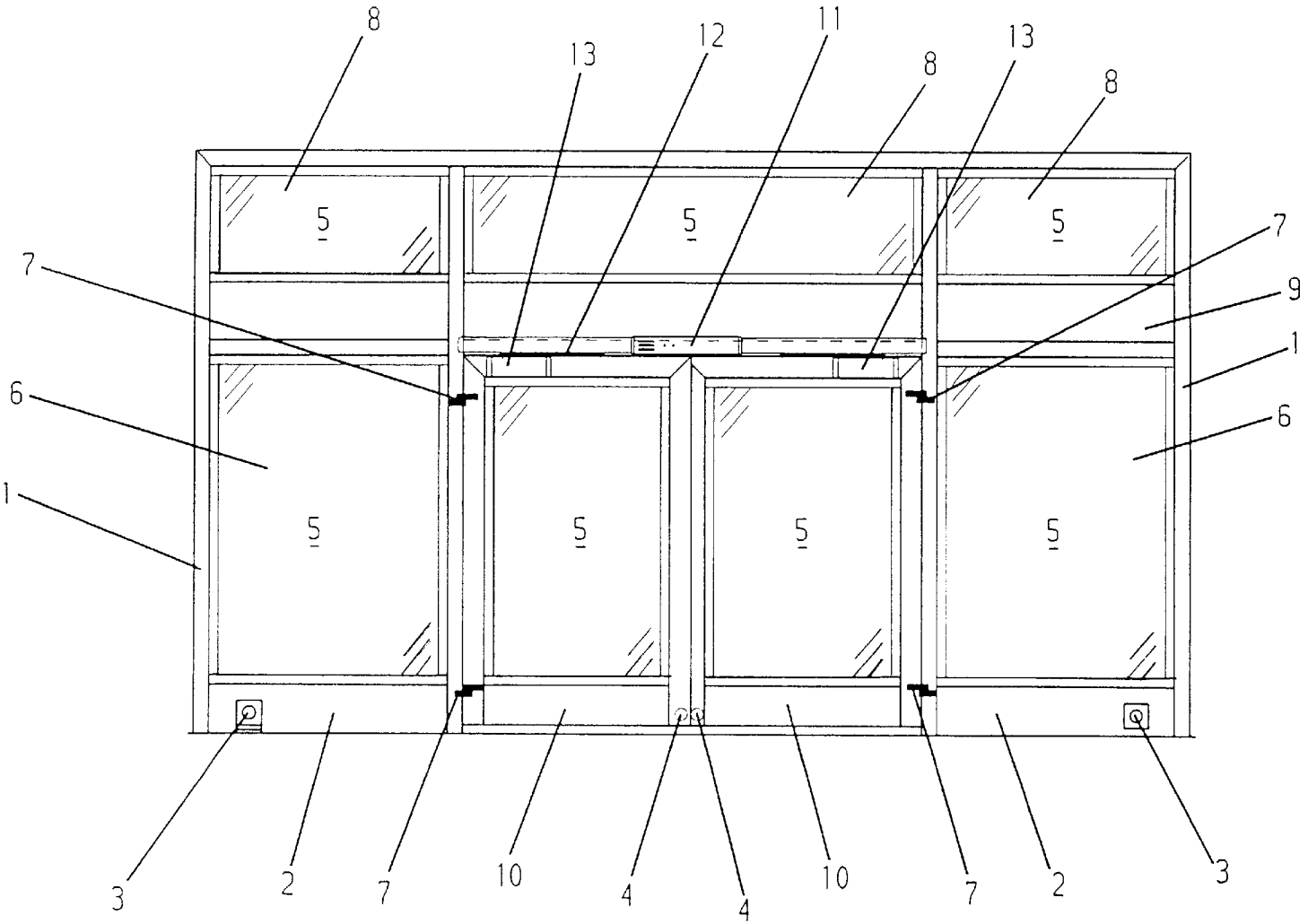
FIG. 4 shows a view of a door system on a two-panel casement door.

The view shown in FIG. 4 can be considered to reflect the outside of a fire door, by way of example. The figure shows a system which is equipped with two casement panels 10 which are connected to a frame construction by means of fasteners 7. The casement panels 10 are framed laterally by stationary side parts 6 and transom lights 8 above them. The total passage width is thereby occupied by corresponding frame profiles 1, whereby glass panels 5 are inserted between the frame profiles 1. In the vicinity of the floor, there are base profiles 2, and above the casement panels 10 there are profiles 9. In this embodiment, the casement panels 10 are equipped with door closers 13 which, in the illustrated embodiment, are in the form of top-mounted door closers. It is also possible, however, to use floor-mounted door closers or spring hinges. On the profile 9, above the casement panels 10, there is also a closing sequence controller 12 which guarantees the correct closing position of the two folding casement panels 10. A smoke detector 11 is also installed on the closing sequence controller 12. This smoke detector 11 can also be installed on the ceiling or in another exposed position. On the side frames 6, on or in the base profiles 2, there are retaining devices 3 which in this case are in the form of switchable electromagnets. The armature plates 4 which interact with the retaining devices 3 are each fastened to the casement panels 10. The retaining devices 3 can be de-energized either by manual actuation of the switch or by a corresponding signal from the smoke detector 11 which, if the casement panels 10 were previously being held in the open position, would mean that the casement panels 10 would then be moved into their normal closed position by the force of the door closers 13.

Figure 5:
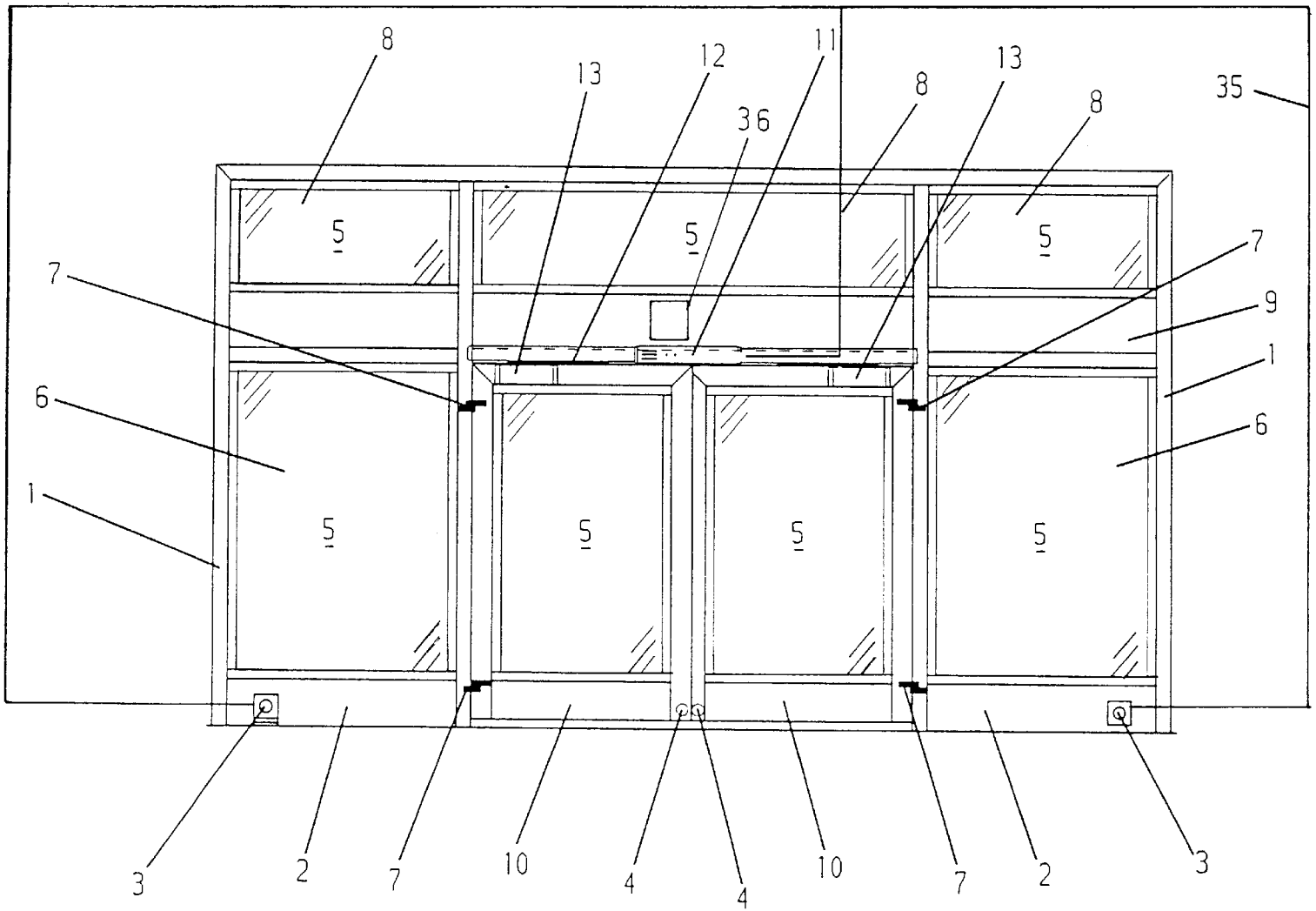
FIG. 5 shows the view of a door system on a two-panel casement door shown in FIG. 4 with possible additional features.

In addition, FIG. 5 schematically illustrates one possible embodiment of the present invention including an example of electrical wiring 35 that acts as a connection between the smoke detector 11 and the retaining devices 3. A signal from the smoke detector 11 is transmitted through the wiring 35 and causes the retaining devices 3 to be de-energized and released from the armature plates 4, thus allowing the casement panels 10 to move into the closed position. An exterior motion sensor 36 for activating the opening and closing of the sliding panels 19 is also illustrated.

Figure 1:
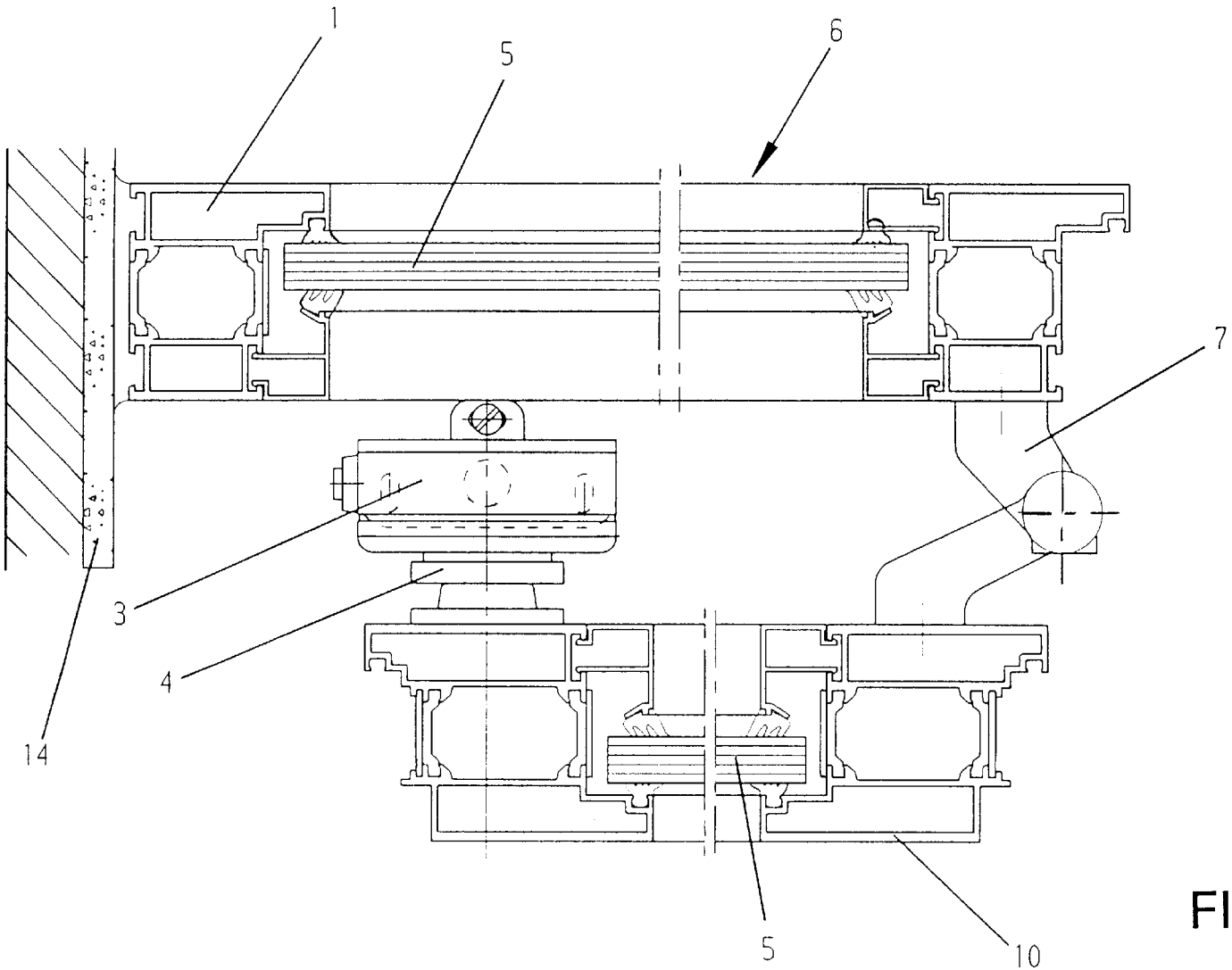
FIG. 1 shows a swung-out casement panel which is held in place by means of a retaining device.

FIG. 1 shows only one casement panel 10 in the open position, in which the armature plate 4 is in contact with the retaining device 3, and the casement panel 10 is held in the open position by magnetic force. This illustration also shows the side piece 6 which is positively and non-positively connected to the profile 1 on a wall 14.

Figure 6:
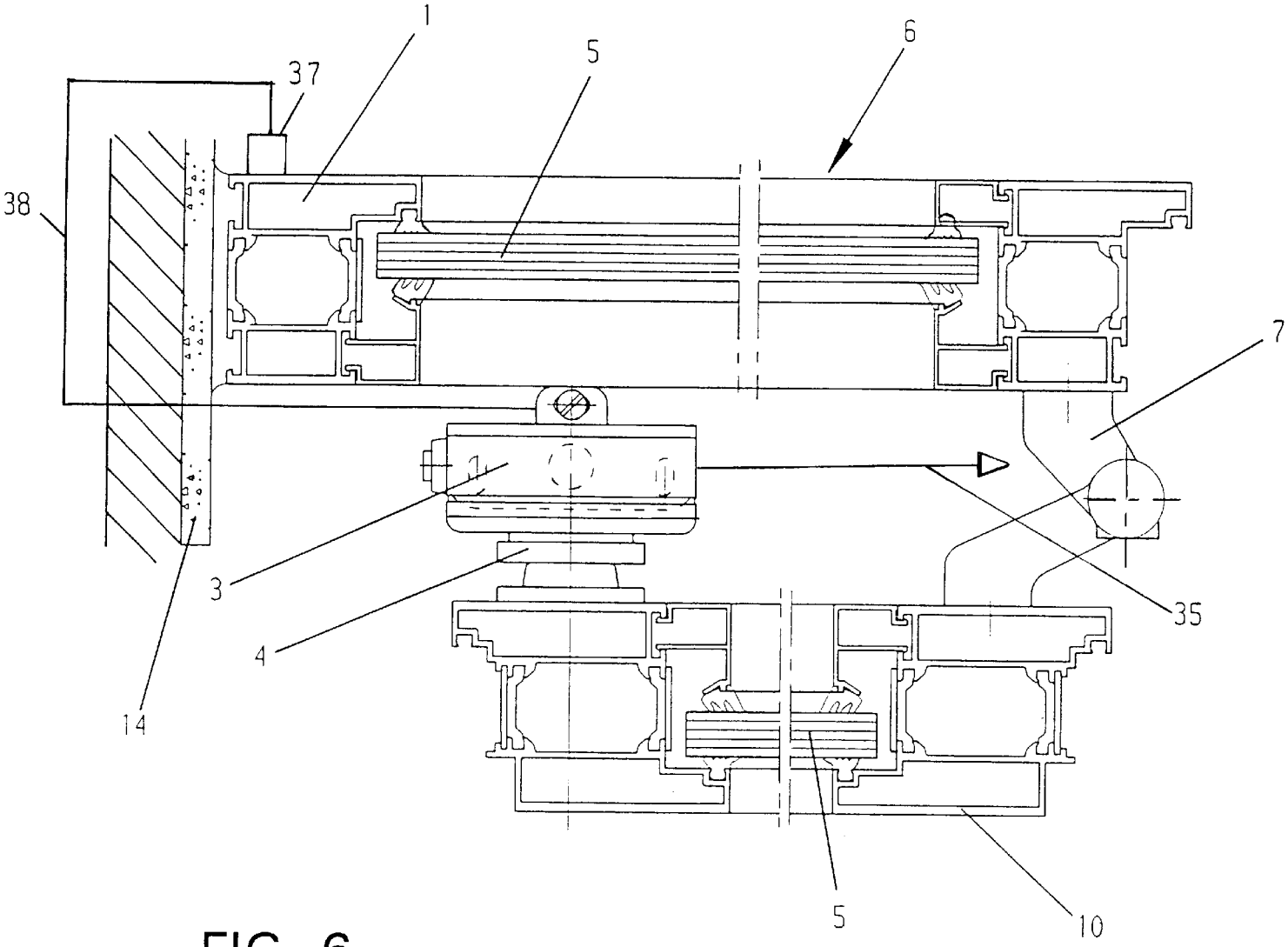
FIG. 6 shows the swung-out casement panel shown in FIG. 1 with possible additional features.

FIG. 6 also shows one possible embodiment of the present invention including a manual actuation switch 37 and corresponding electrical wiring 38. The actuation switch 37 represents a way by which building occupants can manually activate the release of the retaining device 3 in case of a failure of the smoke detector 11 to cause an automatic release. The wiring 38 carries the signal from the actuation switch 37 to the retaining device 3. FIG. 6 also shows wiring 35, as described in FIG. 5, from the retaining device 3 to the smoke detector 11 (not shown).

Figure 2:
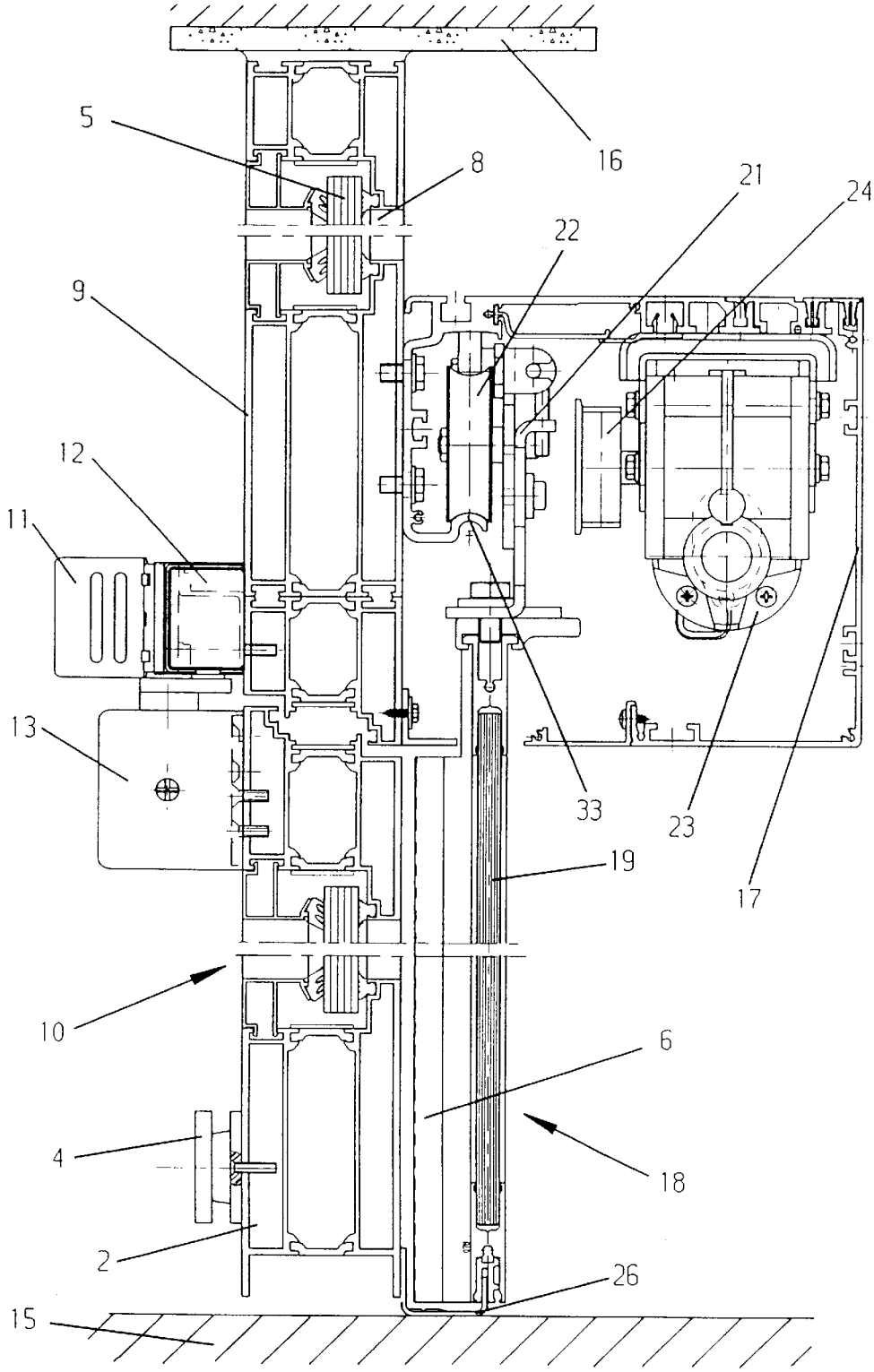
FIG. 2 shows a vertical section through a door system with a casement door and a sliding door connected to it.
Figure 3:
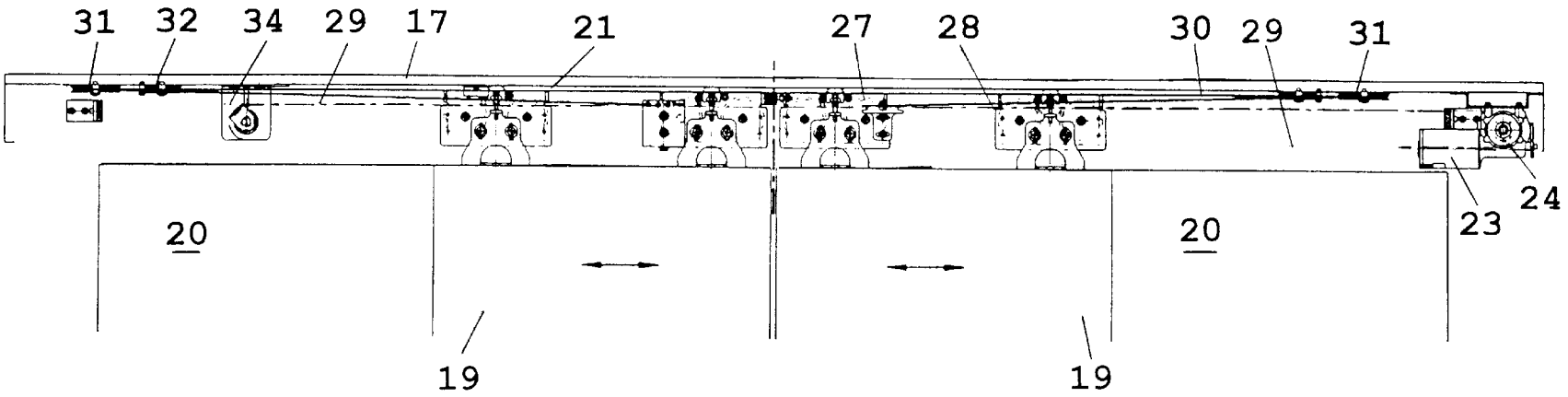
FIG. 3 shows a sliding door with an auxiliary drive mechanism.

The combination of the casement panel 10 described above with a door 18, on which the panels are realized in the form of sliding panels 19, is illustrated in FIG. 2. Between the floor 15 and the ceiling 16, the fire door is installed as illustrated in FIG. 4, whereby in this case, a frame 17 of an automatic sliding door is mounted on the profile 9. The following description relates to this embodiment which includes a sliding door, although the description can also be applied analogously to a telescoping sliding door. The sliding door has a stationary side part 20 which is located behind the stationary side parts 6 of the casement panel doors 10. The movable sliding panel 19 is mounted by means of trucks 21, on which there are support rollers 22, so that the sliding panel can move inside the frame on a rail 33. The sliding panels 19 are driven by a drive belt 29 by means of a drive disc 24 which is connected to a coupling (not shown) and a drive motor 23. The drive belt 29 is thereby guided inside the frame on the side opposite the motor 23 by means of a pulley 31. When people approach the sliding door, the door is moved into the open position by signals from a corresponding sensor, and is then automatically closed again. This closure represents a draft-free bulkhead between two rooms or between a room and an outdoor area. In addition to the drive belts 29, there is an auxiliary drive mechanism which can be in the form of a rubber element 30 which is fastened on one hand to the panel 19 and is reversed by means of a pulley 34, and on the other hand is fastened to the frame 17 by means of a fastening point 32. The path of the rubber element 28 is illustrated in FIG. 3.

The sensor signal from the smoke detector 11 therefore results in a closing of the casement panel 10 and simultaneously, as described above, an opening of the sliding panel 19. The result is a fire door which, when there is no fire, also represents a secure closing of the opening in the wall, and in the event of a fire, leaves the escape route open.

FIG. 2 also shows that such a door 18, in this case a sliding door, can also be retrofitted on an existing fire door. The retrofitting significantly improves the ease of operation of such a system. Although FIG. 2 still shows a profile beam for the sliding door 18, as a result of the presence of the profile 9, the entire mechanism for the sliding can also be attached to the profile positively and non-positively. The invention teaches that it is possible to integrate a sliding door into a fire compartment. For that purpose, as shown in the embodiment illustrated in FIG. 4, it is not necessary to have stationary side pieces 6 or transom lights 8.

Figure 7:
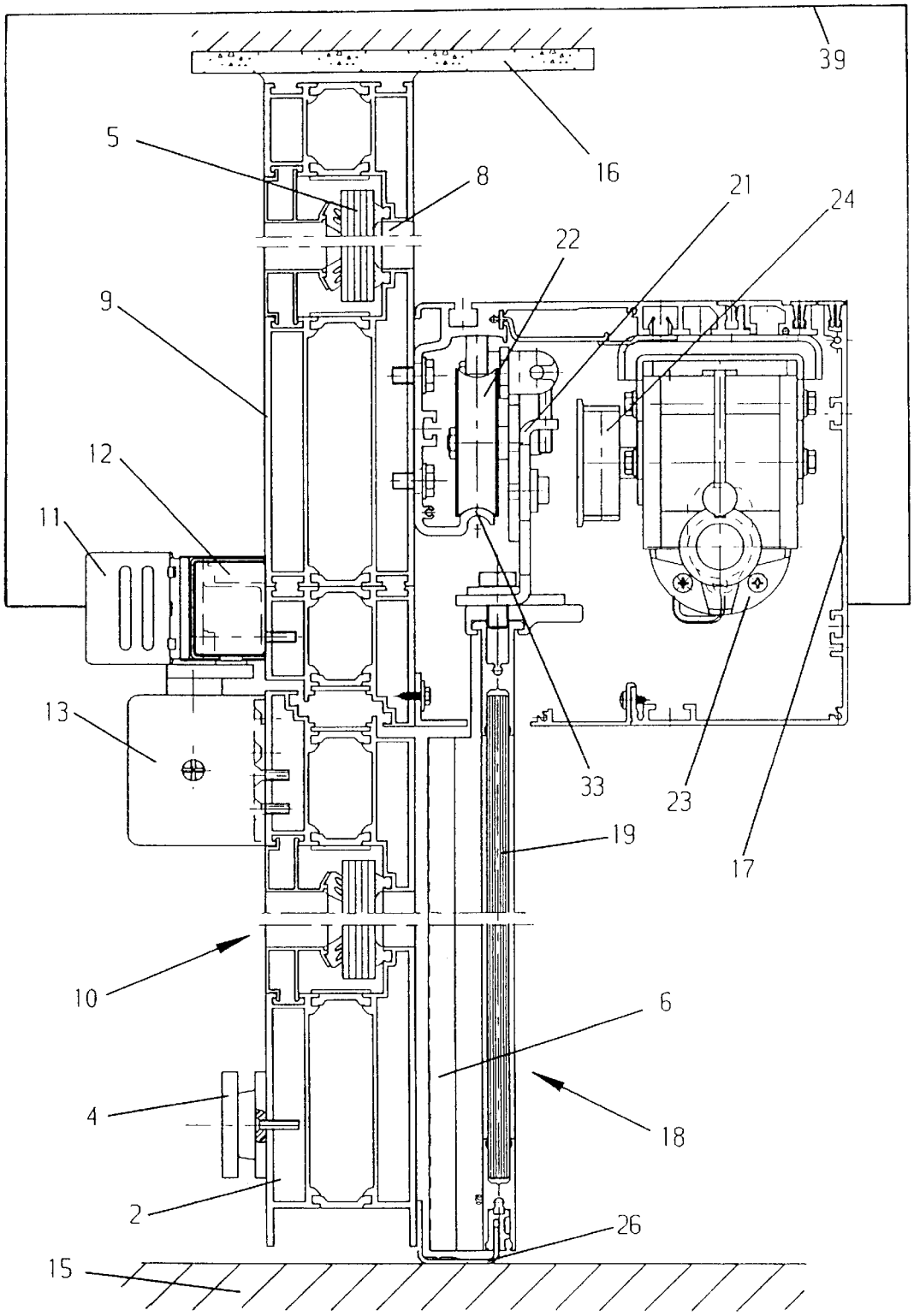
FIG. 7 shows the vertical section through a door system with a casement door and a sliding door connected to it shown in FIG. 2 with possible additional features.

FIG. 7 additionally illustrates electrical wiring 39 which carries the signal from the smoke detector 11 to the drive motor 23. In case of fire, the signal would cause the drive motor 23 to disengage and separate from the drive belt 29, thus allowing the auxiliary drive mechanism, which can be in the form of a rubber element 30, to engage and force the sliding panel 19 into the open position to provide a clear means of escape.

Figure 8:
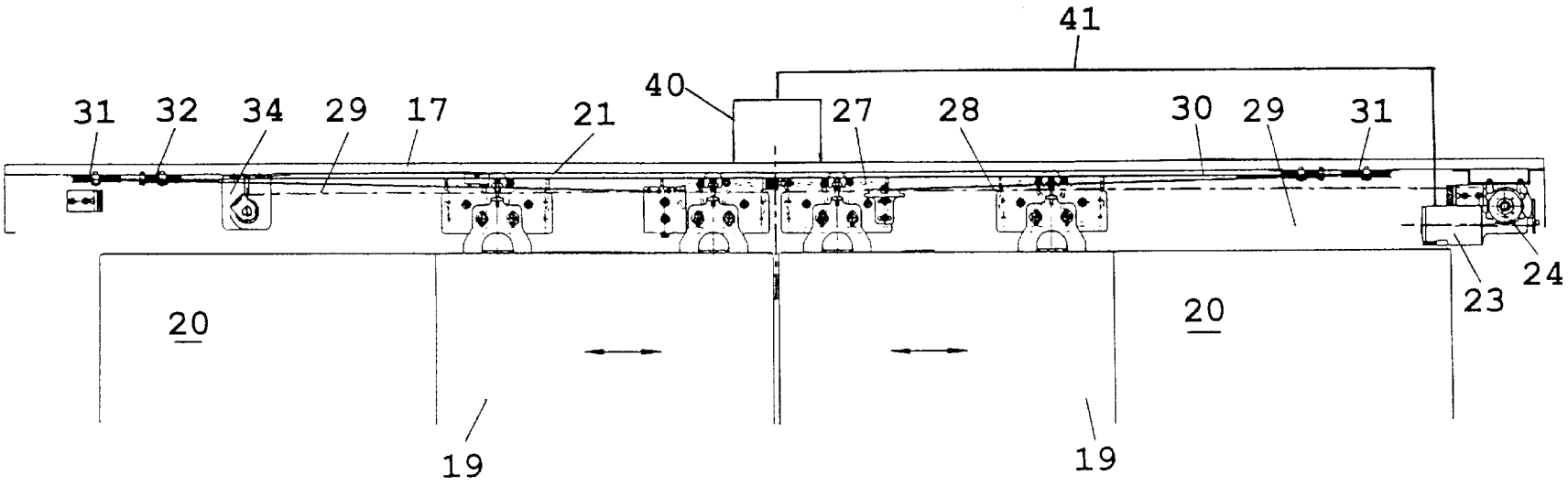
FIG. 8 shows the sliding door with an auxiliary drive mechanism from FIG. 3 with possible additional features.

FIG. 8 shows another possible embodiment with an interior motion sensor 40 with wiring 41. This sensor 40 responds to the motion of approaching occupants and and transmits a signal through the wiring 41 to the drive motor 23, which causes the sliding panels 19 to open and close during normal operation.

Figure 9:
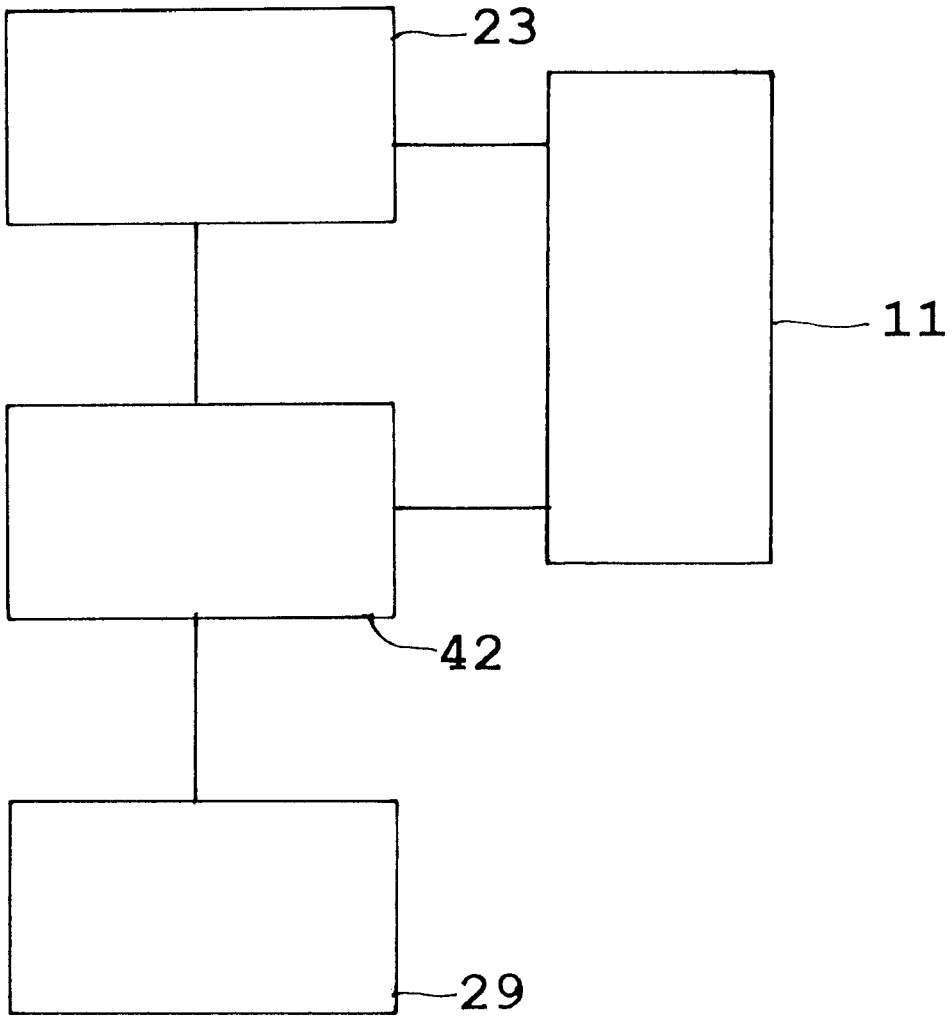
FIG. 9 shows one possible embodiment of a switchable coupling of a drive motor.

FIG. 9 illustrates schematically one possible embodiment including a switchable coupling 42. The switchable coupling can be realized, for example, in the form of an electromagnetic clutch. The switchable coupling connects the drive belt 29 to the drive motor 23. A signal from the smoke detector 11 can cause the drive motor 23 to disengage. A signal from the smoke detector 11 can activate or deactivate the switchable coupling 42. The disengaging of the drive motor 23 can also activate or deactivate the switchable coupling 42. The activation or deactivation of the switchable coupling 42 causes it to open, thus disengaging the drive belt 29 from the drive motor 23. The separation of the drive belt 29 from the drive motor 23 allows the auxiliary drive mechanism to engage as described above in FIG. 7.

One feature of the invention resides broadly in the fire door which has at least one casement panel which is rotationally mounted by means of fasteners or hinges, which casement panel is provided with a closing mechanism which works without outside energy and a door retaining device which can be actuated electrically by a smoke detector, which door retaining device, in the event of an emergency, effects a closing of the panel, characterized by the fact that the fire door consists of a functional combination of a single-panel and/or double-panel casement door 10 and an automatic door 18 which moves horizontally and has at least one panel 19.

Another feature of the invention resides broadly in the fire door characterized by the fact that the door 18 is a sliding door or telescoping door.

Yet another feature of the invention resides broadly in the fire door characterized by the fact that the door 18 with its frame 17 is fastened to a profile 9 in the vicinity of the lintel of the casement door 10.

Still another feature of the invention resides broadly in the fire door characterized by the fact that the fire door is installed in the escape route.

A further feature of the invention resides broadly in the fire door characterized by the fact that the door 18 is provided with an auxiliary drive mechanism to which energy is fed during each closing movement of the sliding panel(s) 19 and in which the energy is stored, and when the coupling is de-energized, the energy of the auxiliary drive mechanism moves the sliding panel(s) 19 into the open position.

Another feature of the invention resides broadly in the fire door characterized by the fact that the casement panel(s) 10 and the surrounding construction of the side piece 6 and transom light 8 are made of wood.

Yet another feature of the invention resides broadly in the fire door characterized by the fact that the casement panel(s) 10 and the surrounding construction of the side piece 6 and transom light 8 are made of steel.

Still another feature of the invention resides broadly in the fire door characterized by the fact that the casement panel(s) 10 and the surrounding construction consisting of the side piece 6 and transom light 8 are made of light alloy metal.

A further feature of the invention resides broadly in the fire door characterized by the fact that the casement panel(s) 10 and the surrounding construction consisting of the side piece 6 and the transom light 8 are made of glass.

Another feature of the invention resides broadly in the method for the operation of a fire door characterized by the fact that in response to the alarm signal from the smoke detector 11, the retaining forces of the retaining device 3 for the stationary fixed casement panel(s) 10 are neutralized, and the casement panel(s) 10 are moved into the closed position by the energy stored in the closing mechanism 13, and simultaneously in response to the alarm signal from the smoke detector 11, the normal automatic drive of the horizontally movable door 18 is deactivated, and thus the energy of the auxiliary drive moves the sliding panel(s) 18 into the open position.

This invention relates to a fire door in which the rotationally mounted panels or leaves or wings are attached to a frame or casing by means of fasteners or hinges, and interact with a closing mechanism which works without outside energy so that when a warning signal is emitted by a smoke detector, the door, which has its door panels in the open position, is moved into the closed position. The invention further relates to a method for the operation of a fire door.

Such fire doors are installed in particular in public buildings, hospitals, hotels, factories, etc., so that when a fire breaks out, the fire can be prevented from spreading to other parts of the building. For that purpose, buildings are divided into individual fire compartments which are separated by fire walls. It is also necessary, however, to provide passages for people to move through these fire walls so that, in the event of a fire for example, people can leave the building as quickly as possible. Therefore, such fire doors must simultaneously meet two requirements; i.e. on one hand they must close automatically when a fire breaks out, but they must simultaneously allow any persons who may still be in the room at the time to leave the room unharmed. Therefore such fire doors are located in the escape routes.

This invention relates to a fire door which consists of a functional combination of at least one single-panel casement door and a sliding door which is connected or adjacent to it. The sliding door, which can be automatically moved horizontally, contains an auxiliary drive mechanism which, in an emergency, moves the sliding door into the open position and simultaneously moves the casement door into the correct closed position.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 196 51 947.0, filed on Dec. 16, 1996, having inventor Christian Hein, and DE-OS 196 51 947.0 and DE-PS 196 51 947.0 and International Application No. PCT/DE97/01759, filed on Aug. 16, 1997, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Some examples of sliding doors which may possibly be utilized or adapted for use in the context of the invention may be disclosed in the following U.S. Pat. No. 5,383,304, issued on Jan. 1, 1995 to inventor Soley.

Some examples of fire doors which may possibly be utilized or adapted for use in the context of the invention may be disclosed in the following U.S. Pat. No. 5,404,969, issued on Apr. 11, 1995 to inventor Hoefsloot; U.S. Pat. No. 5,380,053, issued on Jan. 10, 1995 to inventor Saino; U.S. Pat. No. 5,293,962, issued on Mar. 15, 1994 to inventor Pelvilain; U.S. Pat. No. 5,207,044, issued on May 4, 1993 to inventor LaSee; U.S. Pat. No. 4,888,918, issued on Dec. 26, 1989 to inventors Green and Kreimer; and U.S. Pat. No. 4,799,349, issued on Jan. 24, 1989 to inventor Luckanuck.

Some examples of door-operating mechanisms which may possibly be utilized or adapted for use in the context of the invention may be disclosed in the following U.S. Pat. No. 5,355,927, issued on Oct. 18, 1994 to inventor McKeon; U.S. Pat. No. 5,261,186, issued on Nov. 16, 1993 to inventor Saino; U.S. Pat. No. 5,082,316, issued on Jan. 21, 1992 to inventor Wardlaw; U.S. Pat. No. 5,072,973, issued on Dec. 17, 1991 to inventors Gudgel and Baker; and U.S. Pat. No. 5,044,680, issued on Sep. 3, 1991 to inventors Baker, Benson, and Gudgel.

Some examples of smoke or fire detectors which may possibly be utilized or adapted for use in the context of the invention may be disclosed in the following U.S. Pat. No. 5,315,292, issued on May 24, 1994 to inventor Prior; U.S. Pat. No. 5,170,150, issued on Dec. 8, 1992 to inventors Austin and Ingrassia; and U.S. Pat. No. 5,053,754, issued on Oct. 1, 1991 to inventor Wong.

Some examples of motion detectors or sensors which may possibly be utilized or adapted for use in the context of the invention may be disclosed in the following U.S. Pat. No. 5,196,826, issued on Mar. 23, 1993 to inventor Whiting; U.S. Pat. No. 5,142,152, issued on Jan. 2, 1991 to inventor Boiucaner; and U.S. Pat. No. 4,967,083, issued on Oct. 30, 1991 to inventors Kornbrekke and Boiucaner.

Examples of electromagnetic clutches or couplings which may be incorporated in embodiments of the present invention, may be found in the following U.S. Pat. No. 5,396,976, issued Mar. 14, 1995 to Koitabashi; U.S. Pat. No. 5,428,431, issued Jun. 27, 1995 to Abe et al.; and U.S. Pat. No. 5,445,259, issued Aug. 30, 1993 to Nelson.

Examples of electric motors which could be incorporated in embodiments of the present invention may be found in the following U.S. Pat. No. 5,197,582, issued Mar. 30, 1993 to Cropley; U.S. Pat. No. 5,251,400 issued Oct. 12, 1993 to Schultze; U.S. Pat. No. 5,300,867 issued Apr. 5, 1994 to Brade et al.; U.S. Pat. No. 5,341,598, issued Aug. 30, 1994 to Reddy; and U.S. Pat. No. 5,374,791 issued Dec. 20, 1994 to LeMarchand.

Examples of rotary couplings for doors which may be incorporated in embodiments of the present invention may be found in the following U.S. Pat. No. 5,386,885 issued on Feb. 2, 1995 to Bunzl et al., U.S. Pat. No. 5,401,104, issued on Mar. 28, 1995 to Newton; U.S. Pat. No. 5,417,011, issued May 23, 1995 to Keszthelyi; U.S. Pat. No. 5,443,109, issued Aug. 22, 1995 to Benthin; and U.S. Pat. No. 5,462,015, issued Jun. 1, 1994 to Murphy.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A partition which forms a substantially draft-free fire barrier comprising:

an opening;

an at least one first panel;

said at least one first panel being mounted rotationally on hinges;

said rotationally mounted at least one first panel having an opened and closed position to open and close said opening;

a mechanism to close said rotationally mounted at least one first panel;

said closing mechanism being disposed to move said rotationally mounted at least one first panel into the closed position;

said closing mechanism comprising an arrangement for storing energy to close said rotationally mounted at least one first panel without energy being transferred to said closing mechanism from outside said closing mechanism;

a device to retain said rotationally mounted at least one first panel;

said retaining device being disposed to hold said rotationally mounted at least one first panel in the open position;

said retaining device comprising an arrangement to release said rotationally mounted at least one first panel;

an at least one second panel;

said at least one second panel being disposed to be horizontally movable;

said at least one second panel having an opened and closed position to open and close said opening;

a detection system to sense combustion;

said combustion-sensing detection system being operatively connected to close said rotationally mounted at least one first panel;

said partition is openable and closable;

said at least one second panel comprises one of a sliding door and a telescoping door;

a frame;

said frame being disposed and configured to support said at least one second panel;

a profile;

said profile being disposed adjacent to said at least one first panel;

said frame being disposed to be affixed to said profile;

a drive mechanism;

said drive mechanism being operatively connected to said at least one second panel;

said drive mechanism being configured to move said at least one second panel;

an auxiliary drive mechanism being configured and disposed to move said at least one second panel;

said auxiliary drive mechanism being configured to store energy upon movement of said at least one second panel from said opened position to said closed position;

a switchable coupling;

said switchable coupling being able to be activated to transmit power and able to be deactivated to end transmission of power;

said switchable coupling being connected to said drive mechanism;

a drive belt;

said drive belt being disposed to connect said drive mechanism to said at least one second panel;

said switchable coupling being configured and disposed to disconnect said drive mechanism from said drive belt upon said coupling being in said deactivated condition; and said auxiliary drive mechanism being configured to move said at least one second panel into said opened position upon said switchable coupling disconnecting said drive belt from said drive mechanism.

2. A partition which forms a substantially draft-free fire barrier comprising:

an opening;

an at least one first panel;

said at least one first panel being mounted rotationally on hinges;

said rotationally mounted at least one first panel having an opened and closed position to open and close said opening;

a mechanism to close said rotationally mounted at least one first panel;

said closing mechanism being disposed to move said rotationally mounted at least one first panel into the closed position;

said closing mechanism comprising an arrangement for storing energy to close said rotationally mounted at least one first panel without energy being transferred to said closing mechanism from outside said closing mechanism;

a device to retain said rotationally mounted at least one first panel;

said retaining device being disposed to hold said rotationally mounted at least one first panel in the open position;

said retaining device comprising an arrangement to release said rotationally mounted at least one first panel;

an at least one second panel;

said at least one second panel being disposed to be horizontally movable;

said at least one second panel having an opened and closed position to open and close said opening;

a detection system to sense combustion;

said combustion-sensing detection system being operatively connected to close said rotationally mounted at least one first panel;

a first electrical wiring system;

said first electrical wiring system connecting said combustion-sensing detection system to said retaining device;

said first electrical wiring system being configured to permit actuation of said retaining device upon sensing of combustion by said combustion-sensing detection system;

a second electrical wiring system;

said second electrical wiring system being configured to operatively connect said combustion-sensing detection system to said at least one second panel to close said at least one second panel; and said second electrical wiring system being configured to permit opening of said at least one second panel upon sensing of combustion by said combustion-sensing detection system.

3. The openable and closable partition according to claim 1 comprising:

a first electrical wiring system;

said first electrical wiring system connecting said combustion-sensing detection system to said retaining device;

said first electrical wiring system being configured to permit actuation of said retaining device;

a second electrical wiring system;

said second electrical wiring system connecting said combustion-sensing detection system to said switchable coupling; and said second electrical wiring system being configured to permit deactivation of said switchable coupling.

4. The openable and closable partition according to claim 3 in combination with a passageway wherein:

said openable and closable partition is disposed in said passageway to permit escape from a structure upon a fire occurring in the structure.

5. The openable and closable partition according to claim 4 comprising:

at least one stationary side part;

said at least one stationary side part being disposed adjacent to said at least one first panel and said profile;

a transom arrangement; and said transom arrangement being disposed adjacent to said profile.

6. The openable and closable partition according to claim 5 comprising a functional combination of said at least one first panel and said at least one second panel.

7. The openable and closable partition according to claim 6 wherein:

said at least one first panel comprises one of a), b), c) and d):

a) wood;

b) steel;

c) a light alloy metal; and d) glass;

said at least one stationary side part comprises one of a), b), c) and d):

a) wood;

b) steel;

c) a light alloy metal; and d) glass; and said transom arrangement comprises one of a), b), c) and d):

a) wood;

b) steel;

c) a light alloy metal; and d) glass.

8. A method for operating a partition which forms a substantially draft-free fire barrier, said partition comprising: an opening; an at least one first panel; said at least one first panel being mounted rotationally on hinges; said rotationally mounted at least one first panel having an opened and closed position to open and close said opening; a mechanism to close said rotationally mounted at least one first panel; said closing mechanism being disposed to move said rotationally mounted at least one first panel into the closed position; said closing mechanism comprising an arrangement for storing energy to close said rotationally mounted at least one first panel without energy being transferred to said closing mechanism from outside said closing mechanism; a device to retain said rotationally mounted at least one first panel; said retaining device being disposed to hold said rotationally mounted at least one first panel in the open position; said retaining device comprising an arrangement to release said rotationally mounted at least one first panel; an at least one second panel; said at least one second panel being disposed to be horizontally movable; said at least one second panel having an opened and closed position to open and close said opening; a detection system to sense combustion; said combustion-sensing detection system being operatively connected to close said rotationally mounted at least one first panel; said partition is openable and closable; said at least one second panel comprises one of a sliding door and a telescoping door; a drive mechanism; said drive mechanism being operatively connected to said at least one second panel; said drive mechanism being configured to move said at least one second panel; an auxiliary drive mechanism being configured and disposed to move said at least one second panel; said auxiliary drive mechanism being configured to store energy upon movement of said at least one second panel from said opened position to said closed position; a switchable coupling; said switchable coupling being able to be activated to transmit power and able to be deactivated to disconnect transmission of power; said switchable coupling being connected to said drive mechanism; a drive belt; said drive belt being disposed to connect said drive mechanism to said at least one second panel; said switchable coupling being configured and disposed to disconnect said drive mechanism from said drive belt upon said coupling being in said deactivated condition; and said auxiliary drive mechanism being configured to move said at least one second panel into said opened position upon said switchable coupling disconnecting said drive belt from said drive mechanism, said method comprising the steps of:

activating the retaining device and holding the rotationally mounted at least one first panel in the open position with the retaining device;

storing energy within the closing device to close the rotationally mounted at least one first panel without energy being transferred to the closing mechanism from outside of the closing mechanism;

providing with said combustion-sensing detection system an indication of combustion upon the occurrence of combustion;

releasing from said retaining device the rotationally mounted at least one first panel upon the receiving of said indication of combustion;

moving the rotationally mounted at least one first panel into the closed position with the energy stored in the closing mechanism upon release of the rotationally mounted at least one first panel by said retaining device;

moving the at least one second panel horizontally into its opened position;

said step of moving the at least one second panel horizontally into its opened position comprising one of: sliding of a sliding door or telescopic moving of a telescoping door;

activating the switchable coupling to transmit power;

moving the at least one second panel with the drive mechanism;

storing energy within the auxiliary drive mechanism upon movement of the at least one second panel from the opened position to the closed position;

deactivating the switchable coupling to end transmission of power;

disconnecting the drive belt from the drive mechanism upon said deactivation of the switchable coupling; and activating the auxiliary drive mechanism to move the at least one second panel into the open position upon the disconnection of the drive belt from the drive mechanism.

9. The method for operating the openable and closable partition according to claim 8 in combination with a passageway wherein: said openable and closable partition is disposed in said passageway to permit escape from a structure upon a fire occurring in the structure, said method comprising the steps of:

disposing the openable and closable partition in a passageway; and permitting escape from a structure upon occurrence of fire.

10. An openable and closable partition which forms a substantially draft-free fire barrier to permit persons to exit an area containing a fire, said partition comprising:

an opening;

an at least one first casement panel;

said at least one first casement panel being mounted rotationally on hinges;

said at least one first casement panel having an opened and closed position to open and close said opening;

a mechanism to close said at least one first casement panel;

said closing mechanism being disposed to move said at least one first casement panel into the closed position;

said closing mechanism comprising an arrangement for storing energy to close said at least one first casement panel without energy being transferred to said closing mechanism from outside said closing mechanism;

a device to retain said at least one first casement panel;

said retaining device being disposed to hold said at least one first casement panel in the open position;

said retaining device comprising an arrangement to release said at least one first casement panel;

an at least one second casement panel;

said at least one second casement panel being disposed to be horizontally movable;

said at least one second casement panel having an opened and closed position to open and close said opening;

a detection system to sense combustion;

said combustion-sensing detection system being operatively connected to close said at least one first casement panel;

a drive mechanism;

said drive mechanism being operatively connected to said at least one second casement panel;

said drive mechanism being configured to move said at least one second casement panel;

an auxiliary drive mechanism being configured and disposed to move said at least one second casement panel;

said auxiliary drive mechanism being configured to store energy upon movement of said at least one second casement panel from said opened position to said closed position;

a switchable coupling;

said switchable coupling being able to be activated to transmit power and able to be deactivated to end transmission of power;

said switchable coupling being connected to said drive mechanism;

a drive belt;

said drive belt being disposed to connect said drive mechanism to said at least one second casement panel;

said switchable coupling being configured and disposed to disconnect said drive mechanism from said drive belt upon said coupling being in said deactivated condition; and said auxiliary drive mechanism being configured to move said at least one second casement panel into said opened position upon said switchable coupling disconnecting said drive belt from said drive mechanism.

11. An openable and closable partition which forms a substantially draft-free fire barrier to permit persons to exit an area containing a fire, said partition comprising:

an opening;

an at least one first casement panel;

said at least one first casement panel being mounted rotationally on hinges;

said at least one first casement panel having an opened and closed position to open and close said opening;

a mechanism to close said at least one first casement panel;

said closing mechanism being disposed to move said at least one first casement panel into the closed position;

said closing mechanism comprising an arrangement for storing energy to close said at least one first casement panel without energy being transferred to said closing mechanism from outside said closing mechanism;

a device to retain said at least one first casement panel;

said retaining device being disposed to hold said at least one first casement panel in the open position;

said retaining device comprising an arrangement to release said at least one first casement panel;

an at least one second casement panel;

said at least one second casement panel being disposed to be horizontally movable;

said at least one second casement panel having an opened and closed position to open and close said opening;

a detection system to sense combustion;

said combustion-sensing detection system being operatively connected to close said at least one first casement panel;

a first electrical wiring system;

said first electrical wiring system being configured to connect said combustion-sensing detection system to said retaining device;

said first electrical wiring system being configured to permit actuation of said retaining device upon sensing of combustion by said combustion-sensing detection system;

a second electrical wiring system;

said second electrical wiring system being configured to operatively connect said combustion-sensing detection system to said at least one second casement panel to close said at least one second casement panel; and said second electrical wiring system being configured to permit opening of said at least one second casement panel upon sensing of combustion by said combustion-sensing detection system.

12. The openable and closable partition according to claim 10 comprising:

a first electrical wiring system;

said first electrical wiring system being configured to connect said combustion-sensing detection system to said retaining device;

said first electrical wiring system being configured to permit actuation of said retaining device;

a second electrical wiring system;

said second electrical wiring system being configured to operatively connect said combustion-sensing detection system to said switchable coupling; and said second electrical wiring system being configured to permit deactivation of said switchable coupling.

13. The openable and closable partition according to claim 12 in combination with a passageway wherein:

said openable and closable partition is disposed in said passageway to permit escape from a structure upon a fire occurring in the structure.

14. The openable and closable partition according to claim 13 comprising:

at least one stationary side part;

said at least one stationary side part being disposed adjacent to said at least one first casement panel and said profile;

a transom arrangement; and said transom arrangement being disposed adjacent to said profile.

15. The openable and closable partition according to claim 14 wherein:

said at least one first casement panel comprises one of a), b), c) and d):

a) wood;

b) steel;

c) a light alloy metal; and d) glass;

said at least one stationary side part comprises one of a), b), c) and d):

a) wood;

b) steel;

c) a light alloy metal; and d) glass; and said transom arrangement comprises one of a), b), c) and d):

a) wood;

b) steel;

c) a light alloy metal; and d) glass.

* * * * *